US006244588B1

(12) United States Patent
Tsubakimoto et al.

(10) Patent No.: US 6,244,588 B1
(45) Date of Patent: Jun. 12, 2001

(54) SHEET FEEDING DEVICE AND IMAGE FORMING APPARATUS EQUIPPED WITH THE SAME

(75) Inventors: Yasuhito Tsubakimoto, Toride; Nobukazu Adachi, Yokohama, both of (JP); Yoshihiro Matsuo, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/411,391

(22) Filed: Oct. 4, 1999

(30) Foreign Application Priority Data

Oct. 7, 1998 (JP) ..... 10-300356
Aug. 20, 1999 (JP) ..... 11-233917

(51) Int. Cl.[7] ..... B65H 1/00; B65H 1/22; G03G 15/00

(52) U.S. Cl. ..... 271/164; 271/162; 399/393

(58) Field of Search ..... 271/162, 164; 399/393

(56) References Cited

U.S. PATENT DOCUMENTS 5,005,817 * 4/1991 Ruch et al. ..... 271/9 X
5,157,448 * 10/1992 Lang ..... 355/309 X
5,161,794 11/1992 Adachi ..... 271/272
5,163,670 * 11/1992 Sellers et al. ..... 271/157 X

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

A sheet feeding device comprises a sheet supporting means which is provided so as to be freely drawn out from the main body of an apparatus and supports sheets, a sheet feeding means abutting on the sheets supported by the sheet supporting means to feed the sheets, and a driving means for applying a driving force for feeding the sheets to the sheet feeding means, wherein the sheet supporting means is moved so as to be drawn out from the main body of the apparatus under the driving force of the driving means for driving the sheet feeding means while the sheets supported by the sheet supporting means are not present.

9 Claims, 7 Drawing Sheets

SHEET FEEDING DEVICE AND IMAGE FORMING APPARATUS EQUIPPED WITH THE SAME

BACKGROUND OF THE INVENTION

1. Field of the Invention

The present invention relates to an electrophotographic copying machine, an image forming apparatus such as a laser beam printer or a facsimile machine or the like, which is equipped with a sheet feeding device.

2. Related Background Art

A conventional image forming apparatus equipped with a sheet feeding device has, for instance, a structure shown in FIG. 7.

A sheet feeding cassette 101 for supporting sheets on which images are formed is mounted on a main body of the apparatus. Reference numeral 102 designates a photosensor for detecting whether or not sheets supported by the sheet feeding cassette 101 are present. When there is no sheet in the cassette 101, an actuator 102*a* drops to a hole part 101*a* provided on the bottom plate of the cassette 101, so that the photosensor 102 is turned on. Thus, the detection of no sheets on the cassette can be carried out.

Further, a cassette sensor 106 is provided for detecting whether or not the cassette 101 is mounted on the main body of the apparatus and a protruding part 101*b* is also provided on the cassette side corresponding to the sensor 106.

A rack 103 is formed on the lower part of the side surface of the cassette 101 and a pinion 105 driven to rotate by a motor 104 meshes with the rack 103.

In the structure described above, when all the sheets supported by the cassette 101 are fed so that there is no sheet on the cassette 101, the actuator 102*a* abutting on the sheets drops to the hole part 101*a*. Thus, the photosensor 102 interrupted by the actuator 102*a* is turned on, so that no sheet is detected. When the motor 104 is rotated counterclockwise for a prescribed time under this condition, the cassette 101 is automatically drawn out from the apparatus on which it is mounted because of the engagement of the rack 103 with the pinion 105. Thus, it can be recognized at a glance that the sheets are used up, and hence a user near the apparatus can be notified of a supply of more sheets to the cassette.

However, there have been encountered problems mentioned below in the above described prior art.

Specifically, since the conventional apparatus is designed to drive the motor 104 to automatically draw out the cassette 101 after the detection of no sheets on the cassette 101, the motor for drawing out the cassette 101 needs to be provided. Besides, as transfer members for transferring the driving force of the motor to the cassette 101, members such as the pinion 103 or the rack 105 must be provided.

Further, since a mounting detection sensor for detecting whether or not the sheets are housed in the cassette 101 needs to be provided, it is necessary to provide two sensors including the former sensor and the cassette sensor 106 for detecting whether or not the cassette is mounted on the main body of the apparatus.

Still further, since the frequency of operations for drawing out the cassette 101 from the apparatus is not more than that of ordinary image forming operations and the cassette 101 on which a large quantity of sheets are stacked has been mainly employed on the latest image forming apparatus, the frequency of supply of sheets to the cassette 101 is further reduced as compared with that of the prior art.

Therefore, the provision of the motor for drawing out the cassette 101 as well as the driving motor of the apparatus and the two sensors disadvantageously causes the number of parts to be increased and the cost of assembly to be increased, which would constitute a major factor to increase the cost of a product.

The present invention is devised by taking the above described problems into account and it is an object of the present invention to provide a sheet feeding device with a more simplified structure in which a user can readily supply sheets when the sheets supported by a sheet supporting means are used up in the supporting means, and an image forming apparatus provided with the sheet feeding device.

SUMMARY OF THE INVENTION

According to one aspect of the present invention, the above described object can be attained by providing a sheet feeding device comprising: a sheet supporting means for supporting sheets which is provided so as to be drawn out from a main body of the device, a feeding means abutting on the sheets supported by the sheet supporting means to feed the sheets, and a driving means for applying driving force for feeding the sheets to the sheet feeding means, wherein the sheet support means is moved in a direction in which the sheet supporting means is drawn out from the main body of the device by the driving force of the driving means for driving the feeding means when the sheets supported by the supporting means are completely used up.

DESCRIPTION OF THE PREFERRED EMBODIMENTS

Now, referring to the accompanying drawings, a sheet feeding device and an image forming apparatus equipped with the sheet feeding device according to the present invention will be described in detail hereinafter.

Figure 1:
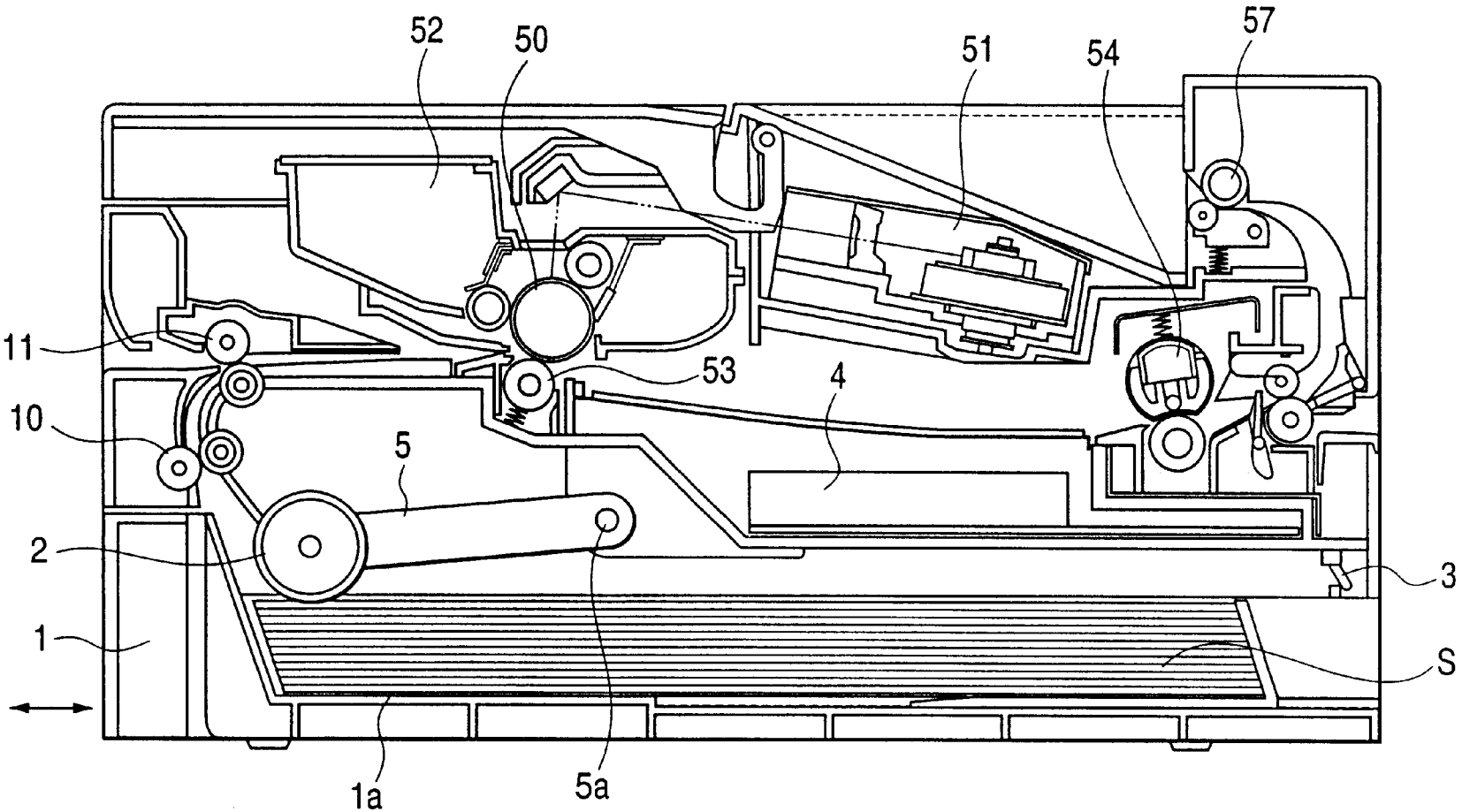
FIG. 1 is a schematic sectional view of a device as a printer according to a first embodiment of the present invention when sheets are stacked on the device.

FIG. 1 is a schematic sectional view of an image forming apparatus equipped with a sheet feeding device according to one embodiment of the present invention.

In this embodiment, a laser beam printer is disclosed as one example of the image forming apparatus. In this instance, however, it should be noted that the dimensions, materials, configurations of components and the relative arrangements thereof or the like described in this embodiment may be suitably changed on the basis of the structure of the apparatus to which the present invention is applied or various kinds of conditions, and the scope of the present invention may not be limited to below mentioned embodiments.

FIRST EMBODIMENT

Now, with reference to FIGS. 1 to 3, a sheet feeding device and an image forming apparatus equipped with the sheet feeding device according to a first embodiment of the present invention will be described below.

As shown in FIG. 1, a main body of the image forming apparatus comprises a sheet feed cassette 1 serving as a sheet supporting means, a feed roller 2 serving as a sheet feeding means for feeding sheets S in the sheet feed cassette 1 one sheet by one sheet, a feed and convey part composed of a pair of convey rollers 10 and 11 for conveying the fed sheets S, a scanner unit 51 for applying information light based on image information to an electrophotographic photosensitive body 50, an image forming means 52 for forming images on the electrophotographic photosensitive body 50, a transfer part 53 for transferring the images formed on the electrophotographic photosensitive body 50 to the sheet S, a fixing portion 54 for fixing the transferred images to the sheet S, a controller 4 for controlling the operation of the image forming apparatus and a driving motor not shown.

The image forming means 52 is provided with the electrophotographic photosensitive body 50 and at least one process means which are unitized as a process cartridge detachably attachable to the main body of the image forming apparatus. Here, as the process means, there are enumerated, for example, a charging means for charging the electrophotographic photosensitive body 50, a developing means for developing a latent image formed on the photoelectric photosensitive body 50, a cleaning means for cleaning toner remaining on the surface of the electrophotographic photosensitive body 50, etc.

An operation of the image forming apparatus will be now described below.

Referring to FIG. 1, the image forming apparatus applies the information light based on the image information to a primarily charged electrophotographic photosensitive body 50 from the scanner unit 51 to form an electrostatic latent image on the surface of the electrophotographic photosensitive body 50, and then forms a visible image by developing the electrostatic latent image. Then, the image forming apparatus feeds, in synchronization with the formation of the visual image, the sheet S to the image forming means 52 through the feed roller 2 and the pair of convey rollers 10 and 11 and transfers a toner image formed on the electrophotographic photosensitive body 50 by the image forming means 52 to the sheet S through the transfer part 53.

The sheet S to which the toner image has been transferred is conveyed to the fixing portion 54 and the toner image transferred to the sheet S is substantially permanently fixed thereto. The sheet S to which the toner image has been fixed is discharged outside the image forming apparatus by means of a pair of discharge rollers 57.

Subsequently, the sheet feeding device to which the present invention is applied will be described by referring to FIGS. 1 to 3.

The sheet feed cassette 1 serving as the sheet supporting means is mounted on the main body of the image forming apparatus so as to be drawn out in the direction shown by the arrow in FIG. 1. The sheet feed cassette 1 is mounted on the main body of the image forming apparatus with sheets S stacked on a sheet support surface 1*a*. When the sheet feed cassette 1 is mounted on the main body of the image forming apparatus, a cassette mounting detection sensor 3, means for detecting whether or not the sheet feed cassette 1 is mounted on the apparatus, detects the mounted state thereof and sends a detection signal to the controller 4. The controller 4 receiving the signal recognizes that the sheet feed cassette 1 is mounted on the main body of the apparatus and lowers the feed roller 2, which is held rotatably at the end part of a feed roller holding arm 5 held pivotally on the main body of the apparatus, from its stand-by position (not shown) so that the feed roller 2 abuts on the uppermost surface of the sheets S supported by the cassette 1.

The sheet feed cassette 1 has a separation inclined surface for separating sheets S one by one at the leading end side of the sheets S in the sheet feeding direction. The pivotal fulcrum 5*a* of the feed roller holding arm 5 for holding the feed roller 2 is provided in an opposite side to the inclined surface for separation with respect to the feed roller 2.

To the feed roller 2 from the driving motor (not shown) serving as the driving means, is transmitted power for rotating the feed roller 2 in the direction for feeding the sheets S.

The leading end of the fed sheet S abuts on the inclined surface for separation due to the rotation of the feed roller 2, so that only the sheet S abutting on the feed roller 2 is bent or curved and separated from one another. A single sheet S thus separated is supplied to the image forming part as described above.

In this manner, the sheet feeding operations are repeated. Thus, the quantity of stack of the sheets S supported on the sheet feed cassette 1 is gradually decreased. As the quantity of the sheets decreases, the position of the feed roller 2 is also moved toward the sheet support surface 1*a* while the feed roller 2 keeps abutting on the uppermost sheet S.

Figure 2:
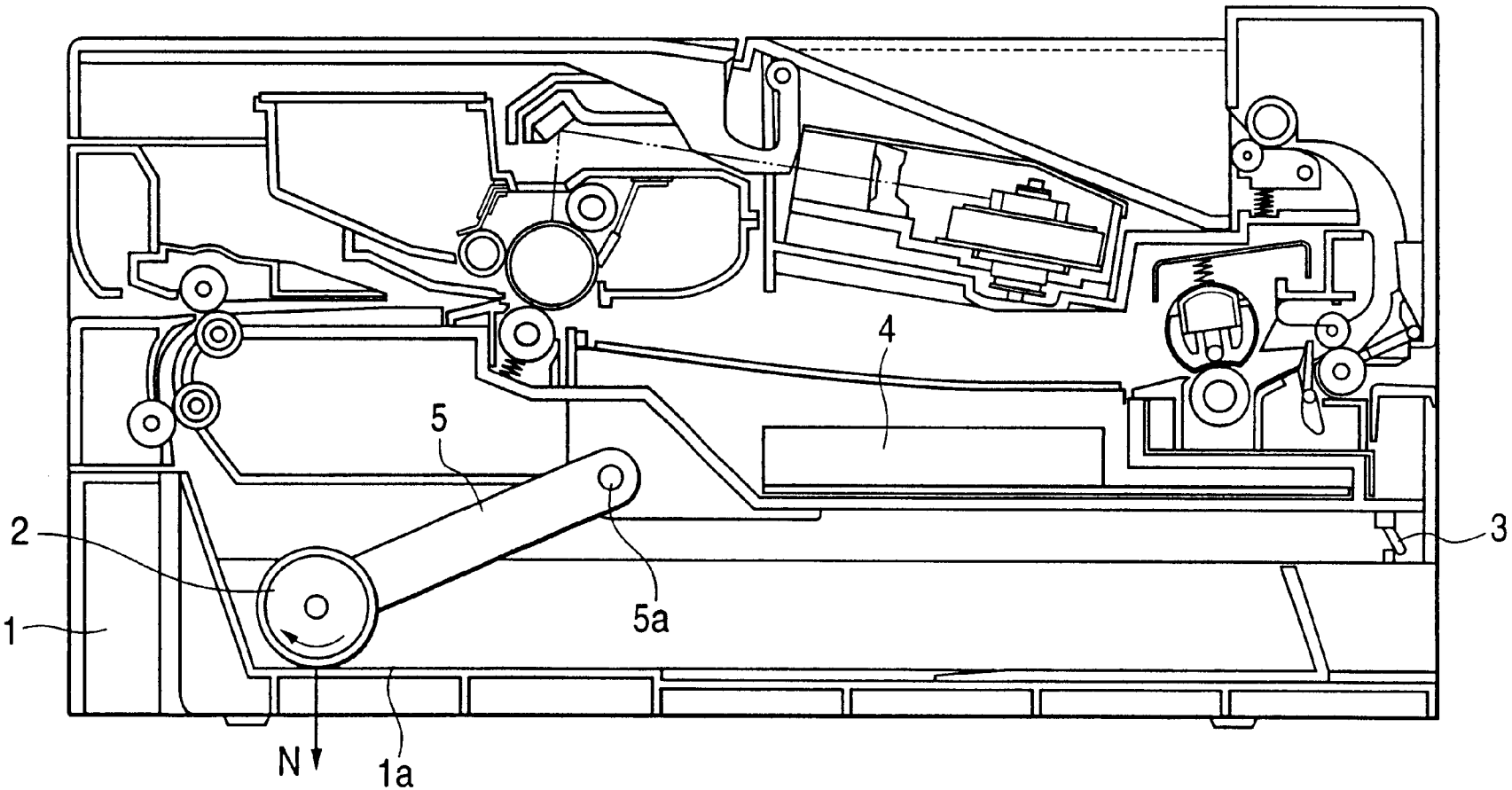
FIG. 2 is a schematic sectional view of the device according to the first embodiment when the sheets are not stacked on the device.

When the last sheet S supported by the sheet feed cassette 1 is completely fed, the feed roller 2 abuts against the sheet support surface 1*a* of the sheet feed cassette 1 as illustrated in FIG. 2. While the feed roller 2 abuts against the sheet support surface 1*a*, the driving motor further transmits driving force to the feed roller 2 as well as feeds the sheets S, so that the feed roller 2 is turned in the direction for feeding the sheet feed cassette 1, that is to say, in the direction for feeding the sheets S.

This turning force permits the sheet feed cassette 1 to be conveyed out of the main body of the apparatus by the feed roller 2. Although the weight of the sheet feed cassette 1 is higher than that of the sheet S, a force (biting force) that the feed roller 2 is apt to bite in the direction shown by an arrow N in FIG. 2 is generated due to an angular moment exerted on the holding arm 5 as well as the tare weight of the feed roller 2, because the pivotal fulcrum 5*a* of the feed roller holding arm 5 is located in the opposite side to the inclined surface for separation and the feed roller 2 supported by the arm 5 is turned in the direction for drawing out or conveying the cassette 1 from the main body of the apparatus. The more the angle of the arm 5 for holding the feed roller 2 relative to the horizontal plane is increased, the more the biting force N is increased.

If the biting force N is increased, a coefficient of static friction applied to an abutting part in which the feed roller 2 abuts on the sheet feed cassette 1 will be increased, and hence the force for feeding the sheet feed cassette 1 by means of the feed roller 2 will become the more increased. Therefore, the heavy sheet feed cassette 1 can be moved so as to be drawn out from the main body of the apparatus under the driving force of the driving motor serving as the driving means for driving the feed roller 2 to feed the sheets S.

Figure 3:
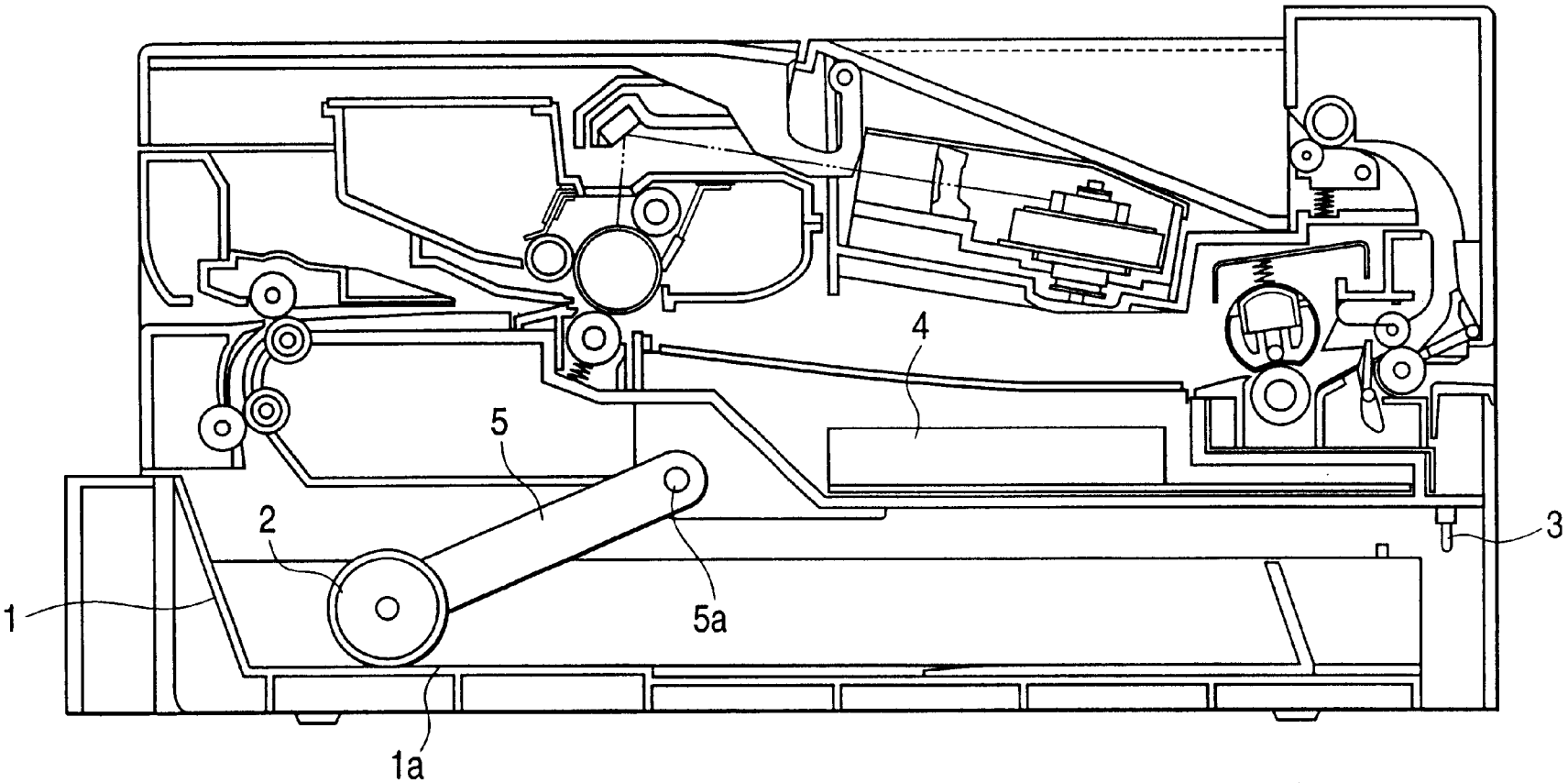
FIG. 3 is a schematic sectional view of the device according to the first embodiment of the present invention when a cassette is moved.

As illustrated in FIG. 3, when the sheet feed cassette 1 is moved from the main body of the apparatus, the mounting detection sensor 3 for detecting whether or not the sheet feed cassette 1 is mounted on the main body of the apparatus detects the movement. Thus, a detection signal is sent to the controller 4. The controller 4 receiving the signal controls the driving motor to stop its driving. Thus, the rotation of the feed roller 2 which feeds or conveys the sheet feed cassette 1 is stopped, so that the movement of the sheet feed cassette 1 is stopped.

Thus, a user can visually recognize that the sheets S in the sheet feed cassette 1 of a printer are completely used up, and further, he does not need to draw out the sheet feed cassette 1 from the printer, and therefore, the sheets can be smoothly supplied to the printer to effectively improve its operability.

Further, since the driving force for driving the feed roller 2 to feed the sheets S to the image forming part can be utilized to draw out the sheet feed cassette 1 from the main body of the apparatus, the motor or the like for moving only the sheet feed cassette which has been conventionally used can be saved. Therefore, the number of parts can be reduced, so that the cost of products can be significantly lowered.

Still further, the part in which the feed roller 2 abuts on the sheet support surface 1*a* may be provided with a member having a large coefficient of friction by which the frictional force between the feed roller 2 and the sheet support surface 1*a* can be more improved.

Still further, when the sheets are not present on the sheet feed cassette 1, the position in which the feed roller 2 abuts on the sheet feed cassette 1 may be preferably located at a position lower than the sheet support surface 1*a*, or in other words, the bottom of the sheet support surface 1*a* is raised to be provided at a position higher than the bottom surface of the sheet feed cassette 1 so that the feed roller 2 abuts on the bottom surface of the sheet feed cassette 1 when the sheets are not present on the sheet support surface 1*a*. Thus, the biting force N relative to the sheet feed cassette 1 can be increased.

SECOND EMBODIMENT

Figure 4:
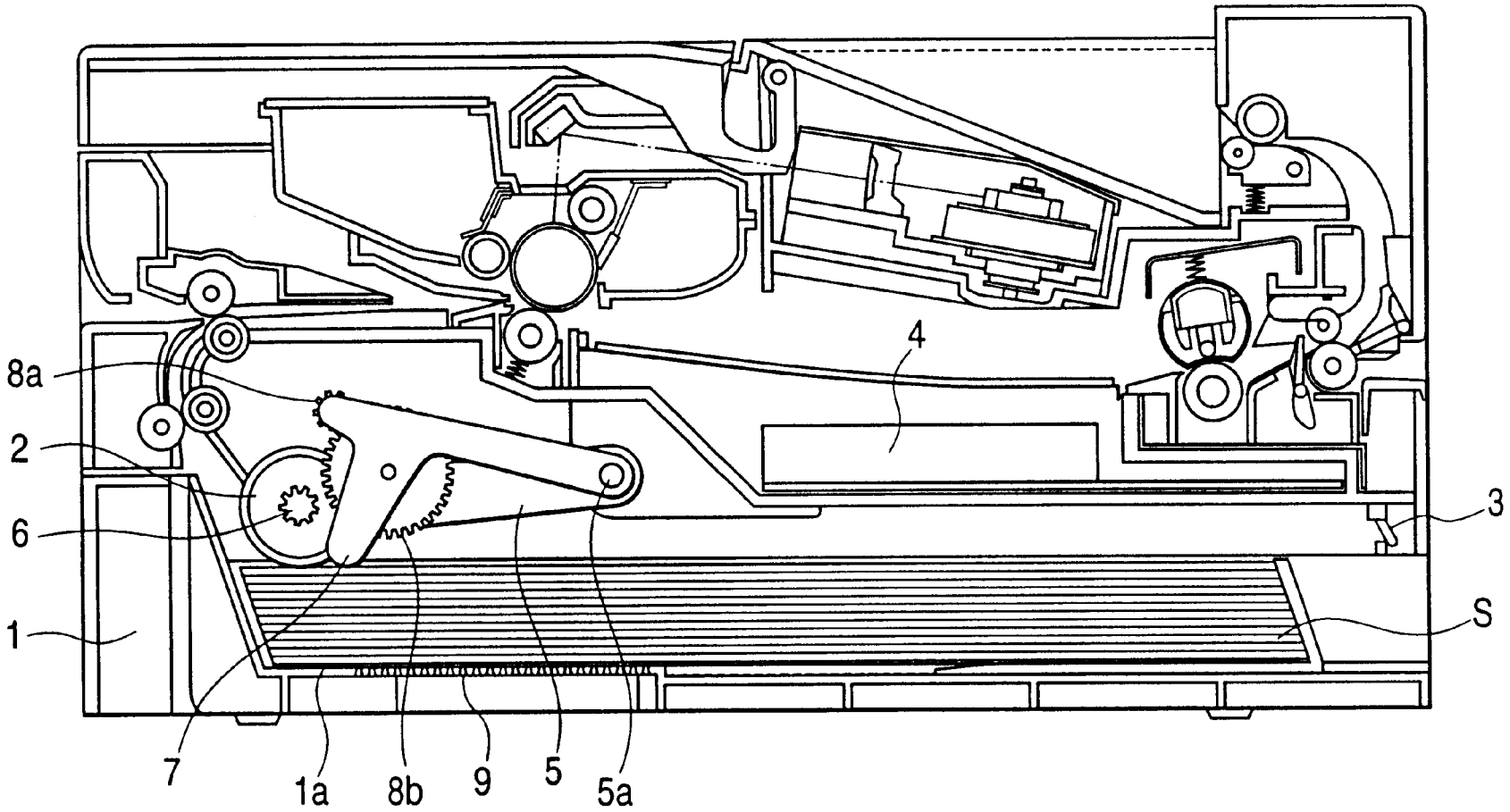
FIG. 4 is a schematic sectional view of a device according to a second embodiment of the present invention when the sheets are stacked on the device.
Figure 5:
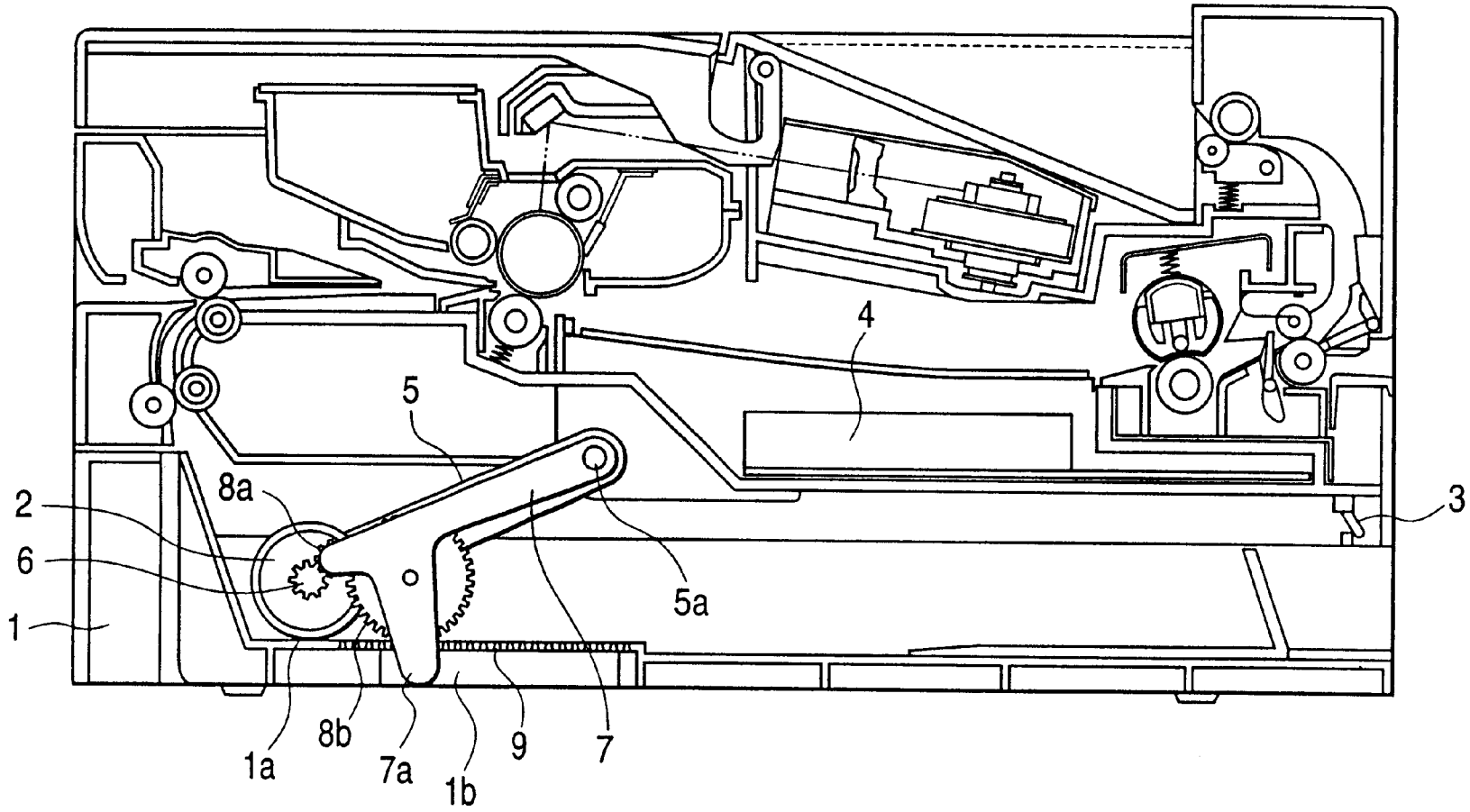
FIG. 5 is a schematic sectional view of the device according to the second embodiment of the present invention when the sheets are not stacked on the device.
Figure 6:
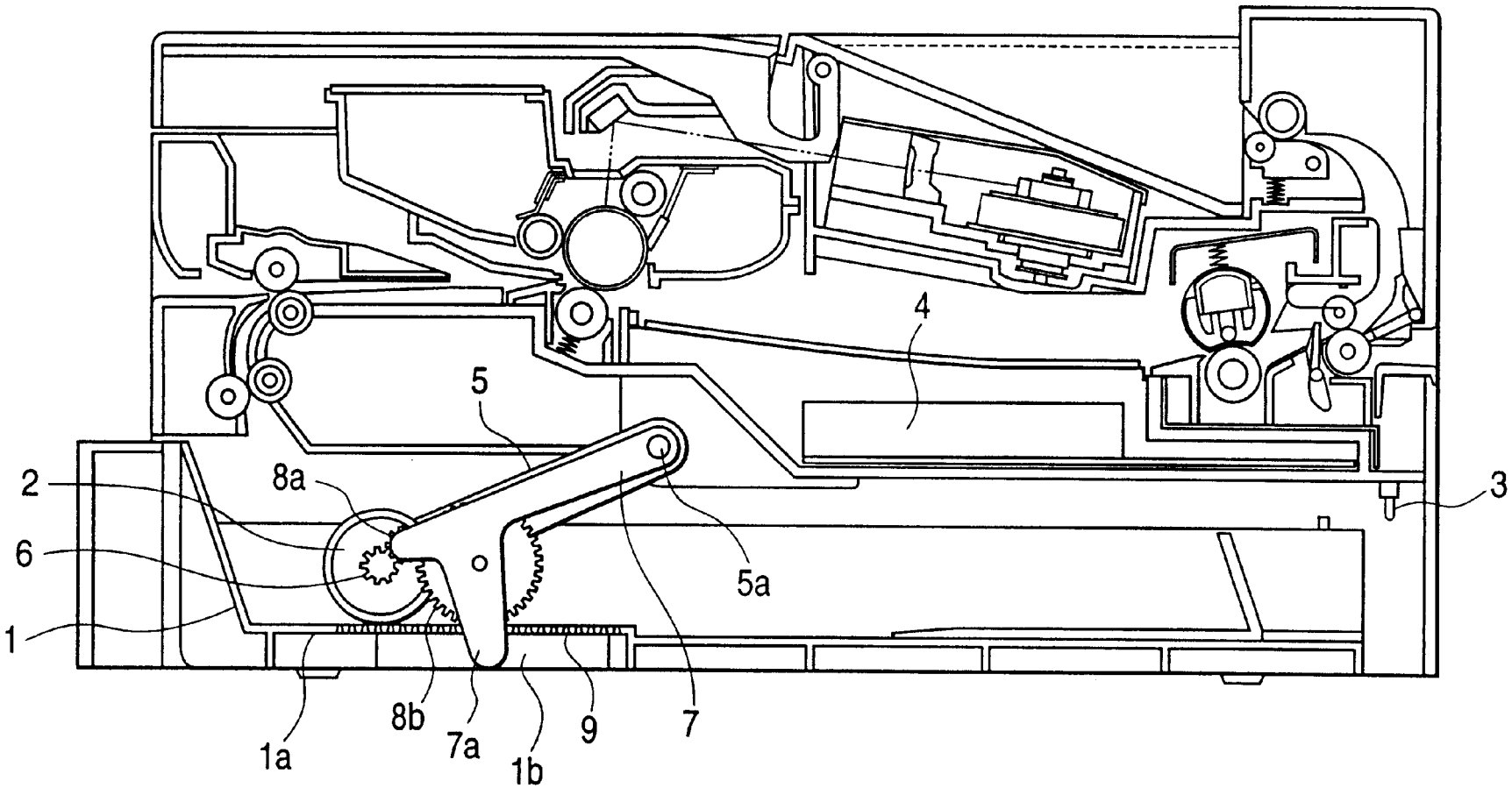
FIG. 6 is a schematic sectional view of the device according to the second embodiment of the present invention when a cassette is moved.
Figure 7:
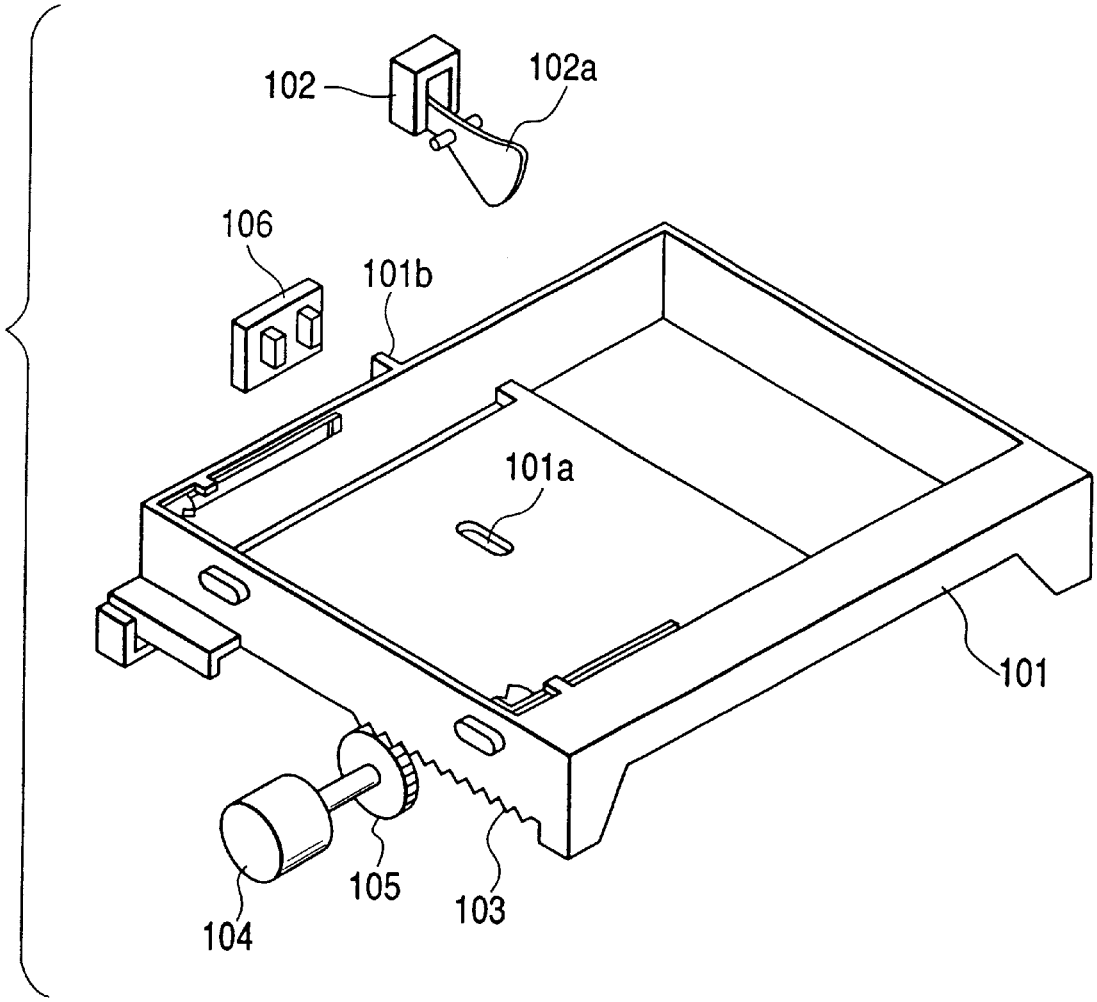
FIG. 7 is a schematic sectional view of a conventional image forming apparatus.

Turning to FIGS. 4 to 6, a second embodiment of the present invention will now be described below. The similar members to those employed in the first embodiment are designated by the same or like reference characters and the explanation thereof will be omitted.

On the rotating shaft of a feed roller 2 is provided a feed gear 6 as a transmitting means which receives a turning force transmitted from a driving motor to rotate.

Further, in the pivotal fulcrum 5*a* of a feed roller holding arm 5 for holding or supporting the feed roller 2 on the main body of an image forming apparatus, a pivoting arm 7 is provided as a transmitting means which abuts on an uppermost sheet S supported on a sheet feed cassette 1 and pivotally moves as the quantity of the sheets stacked on the sheet feed cassette 1 increases and decreases. The arm 7 has an end part opposite to the pivotal fulcrum 5*a* divided or branched into two. The branched end parts are respectively provided with rotatably supported idler gears 8*a* and 8*b*. The idler gears 8*a* and 8*b* mesh with each other. Further, a rack 9 capable of engaging with the idler gear 8*b* is provided on the sheet support surface 1*a* of the sheet feed cassette 1.

When the sheets S are stacked on the sheet feed cassette 1 and the sheet feed cassette 1 is mounted on the main body of the image forming apparatus, the mounted state of the sheet feed cassette 1 detected by a mounting detection sensor 3 is recognized by a controller 4, so that the feed roller 2 and the pivoting arm 7 abut on the uppermost sheet S.

Under this state, a driving force is transmitted to the feed roller 2 from the driving motor, the sheets S are supplied to an image forming part in a similar manner to that of the first embodiment. Thus, the quantity of the sheets S stacked on the sheet feed cassette 1 is gradually decreased. As the quantity of the sheets S stacked on the sheet feed cassette 1 decreases, the positions of the feed roller 2 and the pivoting arm 7 change.

As shown in FIG. 5, when the last sheet S supported on the sheet feed cassette 1 is conveyed to the image forming part, the branched end part 7*a* of the pivoting arm 7 which supports the idler gears 8*a* and 8*b* drops to a hole part 1*b* provided in the sheet feed cassette 1. When the pivoting arm 7 drops to the hole part 1*b*, the feed gear 6 provided on the rotating shaft of the feed roller 2 meshes with the idler gear 8*a*, and further, the idler gear 8*b* meshes with the rack 9 provided on the sheet feed cassette 1. Thus, the driving force for rotating the feed roller 2 can be transmitted to the sheet feed cassette 1 via the idler gears 8*a* and 8*b*.

The driving motor not shown continuously applies to the feed roller 2 a driving force similar to the driving force for driving the feed roller 2 to feed the sheets S, and hence the feed roller 6, and the idler gears 8*a* and 8*b* transmits the driving force to the rack 9. Accordingly, the sheet feed cassette 1 is caused to move so as to be pushed out of the main body of the apparatus.

As shown in FIG. 6, when the sheet feed cassette 1 is pushed out of the main body of the apparatus, the mounting detection sensor 3 for detecting whether or not the sheet feed cassette 1 is mounted on the apparatus detects the movement of the sheet feed cassette 1 and the controller 4 receiving a signal indicating the movement stops the driving of the driving motor, so that the rotation of the feed roller 2 is stopped, and accordingly, the movement of the sheet feed cassette 1 can be also stopped.

Therefore, since a user can visually recognize that the sheets S are completely used up on the sheet feed cassette 1 of a printer, as is similar to the first embodiment, and he does not need to draw out the sheet feed cassette 1 from the printer, he can smoothly supply the sheets S to the sheet feed cassette 1.

Further, the pivoting arm 7, the feed gear 6 and the idler gears 8*a* and 8*b* provided as the transmitting means have very simple structure. Therefore, a cost can be reduced greatly as compared with the provision of a separate motor only for moving the sheet feed cassette 1.

According to this embodiment, although the feed gear 6 provided on the feed roller 2 engages with the idler gear 8*a*, it should be noted that the timing for engagement is not limited to when the sheets S are not present on the sheet feed cassette 1.

Further, according to this embodiment, although the feed gear 6, the idler gears 8*a* and 8*b* and the rack 9 are employed as members for transmitting the turning force for feeding the sheets S by the feed roller 2 to the sheet feed cassette 1, needless to say, the present invention is not limited to these structure. Other structures capable of transmitting the driving force of the driving means for rotating the feed roller 2 to the sheet feed cassette 1 may achieve similar or equal effects to those of the present embodiment.

Still further, according to this embodiment, although the idler gears 8*a* and 8*b* are provided in order to transmit the driving force from the feed gear 6 provided on the feed roller 2 to the sheet feed cassette 1, it should be recognized that the number of the idler gears may be set to an arbitrary number on the basis of the rotating direction of the motor and the direction to which the sheet feed cassette 1 is drawn out.

More specifically, if the feed roller 2 can be rotated in the direction reverse to the feeding direction of the sheets S or if the driving motor not shown can be forwardly and reversely rotated, the even number of idler gears held by the pivoting arm 7 may not be provided but the odd number of idler gears may feed the sheet feed cassette out of the main body of the apparatus. In this connection, it should be noted that, if the direction to which the sheet feed cassette is pushed out of the main body of the apparatus is opposite to the sheet feeding direction, the even number of idler gears as the transmitting members may be changed to the odd number of idler gears and the odd number of idler gears may be changed to the even number of idler gears.

As stated in the first and second embodiments of the present invention, since the sheet feed cassette 1 can be moved to a position in which the cassette is drawn out from the main body of the apparatus by using the driving force for feeding the sheets S through the feed roller 2, the sheet feeding device and the image forming apparatus equipped with the sheet feeding device with the excellent maneuverability of a user can be provided at low cost without requiring the driving means for moving the sheet feed cassette 1 as compared with the prior art.

Still further, according to the foregoing embodiments of the present invention, although the controller 4 recognizes the movement of the sheet feed cassette 1 and controls the driving means to stop its driving operation, needless to say, the controller may control the arm 5 for holding the feed roller 2 to be raised to its stand-by position after its detects the movement of the sheet feed cassette 1 so that the movement of the sheet feed cassette 1 can be stopped.

Furthermore, according to the foregoing embodiments of the present invention, although the mounting detection sensor 3 is provided for detecting whether or not the sheet feed cassette 1 is mounted on the apparatus so as to stop the driving operation of the driving means on the basis of the detection result thereof, it should be noted that the present invention is not limited thereto. For example, a sensor may be provided as a detecting means for detecting the quantity of a stack of sheets S stacked on the sheet feed cassette 1 and the driving means may be controlled to stop its driving operation with a lapse of prescribed time required for moving the sheet feed cassette 1 from the main body of the apparatus under the driving force of the feed roller 2, after the sensor detects that the sheets S supported by the sheet feed cassette 1 are completely used up.

Besides, in the structure having the sensor for detecting the quantity of a stack of sheets, the feed roller 2 may be raised to its stand-by position after the lapse of prescribed time.

What is claimed is:

1. A sheet feeding device comprising:

sheet supporting means which can be drawn out from a main body of an apparatus and adapted to support sheets;

feeding means abutting on the sheets supported by said sheet supporting means to feed the sheets; and driving means for applying a driving force for feeding the sheets to said feeding means;

wherein said sheet supporting means is moved in a direction in which said sheet supporting means is drawn out from the main body of the apparatus by the driving force of said driving means for driving said feeding means in a condition where the sheets supported by said sheet supporting means are not present.

2. A sheet feeding device according to claim 1, wherein, when the sheets supported by said sheet supporting means are not present by feeding the sheets by means of said feeding means, said feeding means abuts on a sheet support surface of said sheet supporting means so that said feeding means moves said sheet supporting means in the direction in which said sheet supporting means is drawn out from the main body of the apparatus.

3. A sheet feeding device according to claim 1, further comprising transmitting means capable of transmitting a driving force for feeding the sheets to said sheet supporting means from said feeding means.

4. A sheet feeding device according to claim 3, wherein said transmitting means includes a feed gear provided on said feeding means and rotated by the driving force of said driving means, an idler gear abutted on the sheet supported by said sheet supporting means and rotatably supported by a pivoting arm and pivotally moving as quantity of the sheets increases and decreases, and a rack provided on the sheet support surface of said sheet supporting means; and when the sheets supported by said sheet supporting means are fed by said feeding means and not present, the idler gear provided on the pivoting arm meshes with said rack provided on the sheet support surface of said sheet supporting means so that said sheet supporting means is moved so as to be drawn out from the main body of the apparatus by the driving force of said driving means for driving said feeding means, the driving force being transmitted from the idler gear provided on said feeding means to the rack.

5. A sheet feeding device according to claim 1, further comprising mounting detecting means for detecting whether or not said sheet supporting means is mounted on the main body of the apparatus.

6. A sheet feeding device according to claim 5, further comprising control means for recognizing that said sheet supporting means is drawn out from the main body of the apparatus on the basis of a detection result of said mounting detecting means and for effecting control to stop moving of said sheet supporting means.

7. A sheet feeding device according to claim 1, wherein said feeding means is a feed roller provided in a holding member pivotally held on the main body of the apparatus.

8. A sheet feeding device according to claim 7, wherein said sheet supporting means is provided with a separation inclined surface for separating the sheets at a leading end side of the sheet in a sheet feeding direction, and a fulcrum for pivoting of said holding member is positioned at an opposite side to said separation inclined surface with respect to said feeding roller.

9. An image forming apparatus comprising:

sheet supporting means which can be drawn out from a main body of said apparatus and adapted to support sheets;

feeding means abutting on the sheets supported by said sheet supporting means to feed the sheets;

driving means for applying a driving force for feeding the sheets to said feeding means; and image forming means for forming images on the sheets fed from said feeding means, wherein said sheet supporting means is moved in a direction in which said sheet supporting means is drawn out from the main body of said apparatus by the driving force of said driving means for driving said feeding means in a condition where the sheets supported by said sheet supporting means are not present.

* * * * *

UNITED STATES PATENT AND TRADEMARK OFFICE

CERTIFICATE OF CORRECTION

PATENT NO. : 6,244,588 B1
DATED : June 12, 2001
INVENTOR(S) : Yasuhito Tsubakimoto et al.

It is certified that error appears in the above-identified patent and that said Letters Patent is hereby corrected as shown below:

Column 4,
Line 62, "the more" should read -- all the more --.

Column 6,
Line 43, "a" should read -- the --.
Line 56, "structure." should read -- structures. --.

Column 7,
Line 28, "its" (2nd occurrences) should read -- it --.
Line 59, "means;" should read -- means, --.

Signed and Sealed this

Sixteenth Day of April, 2002

*Attest:*

*Attesting Officer*

JAMES E. ROGAN
*Director of the United States Patent and Trademark Office*